US010636355B2

(12) United States Patent
Lin et al.

(10) Patent No.: US 10,636,355 B2
(45) Date of Patent: Apr. 28, 2020

(54) EARLY PIXEL RESET SYSTEMS AND METHODS

(71) Applicant: Apple Inc., Cupertino, CA (US)

(72) Inventors: Hung Sheng Lin, San Jose, CA (US); Mohammad Ali Jangda, Cupertino, CA (US); Injae Hwang, Tokyo (JP); Rui Zhang, Santa Clara, CA (US); Shengkui Gao, San Jose, CA (US); Hyunwoo Nho, Stanford, CA (US); Wei H. Yao, Palo Alto, CA (US); Mohammad Hajirostam, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/964,662

(22) Filed: Apr. 27, 2018

(65) Prior Publication Data

US 2018/0268758 A1 Sep. 20, 2018

Related U.S. Application Data

(63) Continuation-in-part of application No. 15/664,982, filed on Jul. 31, 2017.

(60) Provisional application No. 62/472,894, filed on Mar. 17, 2017.

(51) Int. Cl.
*G09G 3/3233* (2016.01)
*G09G 3/3216* (2016.01)

(52) U.S. Cl.
CPC ..... *G09G 3/3233* (2013.01); *G09G 3/3216* (2013.01); *G09G 2300/0819* (2013.01); *G09G 2300/0842* (2013.01); *G09G 2300/0861* (2013.01); *G09G 2310/0251* (2013.01); *G09G 2310/061* (2013.01); *G09G 2310/062* (2013.01); *G09G 2320/0233* (2013.01); *G09G 2320/0252* (2013.01); *G09G 2320/045* (2013.01)

(58) Field of Classification Search
USPC ..... 345/691
See application file for complete search history.

(56) References Cited

U.S. PATENT DOCUMENTS

| | | | | |
|---|---|---|---|---|
| 7,750,875 | B2 | 7/2010 | Kim et al. | |
| 8,648,848 | B2 | 2/2014 | Tsai et al. | |
| 9,626,893 | B2 | 4/2017 | Kim | |
| 10,417,971 | B2 * | 9/2019 | Lin | G09G 3/3266 |
| 2007/0024537 | A1 * | 2/2007 | Choong | G09G 3/3216 345/76 |
| 2009/0109138 | A1 * | 4/2009 | Choi | G09G 3/2965 345/60 |
| 2010/0188390 | A1 * | 7/2010 | Min | G09G 3/3233 345/212 |

(Continued)

*Primary Examiner* — Chineyere D Wills-Burns
(74) *Attorney, Agent, or Firm* — Fletcher Yoder PC

(57) ABSTRACT

An electronic device includes processors that generate image data. The electronic device also includes an electronic display that displays the image data over a first frame duration by programming a first row of display pixels with the image data. The electronic display also displays the image data over the first frame duration by causing the first row of display pixels to emit light for an emission duration that is based at least in part on a first luminance of the image data. The electronic display further displays the image data over the first frame duration by resetting the first row of pixels at least two times before an end of the first frame duration.

20 Claims, 10 Drawing Sheets

(56) References Cited

U.S. PATENT DOCUMENTS

| | | | | |
|---|---|---|---|---|
| 2011/0157133 | A1* | 6/2011 | Ogura | G09G 3/20 345/211 |
| 2011/0234911 | A1* | 9/2011 | Nakamura | G09G 3/3233 348/687 |
| 2011/0279435 | A1* | 11/2011 | Tsai | G09G 3/3233 345/212 |
| 2012/0050350 | A1* | 3/2012 | Matsui | G09G 3/3266 345/690 |
| 2013/0249955 | A1* | 9/2013 | Kim | G09G 3/3233 345/690 |
| 2014/0285543 | A1* | 9/2014 | Kim | G09G 3/3614 345/694 |
| 2015/0015557 | A1* | 1/2015 | Kim | G09G 3/2022 345/211 |
| 2015/0054722 | A1* | 2/2015 | Kanda | G09G 3/3233 345/77 |
| 2017/0163266 | A1* | 6/2017 | Chen | G09G 3/3258 |
| 2018/0012553 | A1* | 1/2018 | Kim | G09G 3/3648 |

* cited by examiner

EARLY PIXEL RESET SYSTEMS AND METHODS

CROSS-REFERENCE TO RELATED APPLICATIONS

This application is a continuation-in-part of U.S. application Ser. No. 15/664,982, filed Jul. 31, 2017, entitled "Early Pixel Reset Systems and Methods," which claims priority to U.S. Provisional Patent Application No. 62/472,894, filed Mar. 17, 2017, entitled "Early Pixel Reset Systems and Methods," the contents of which is incorporated by reference in its entirety.

BACKGROUND

The present disclosure relates generally to electronic displays and, more particularly, improving response time in the electronic displays.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic devices often use electronic displays to present visual representations of information as text, still images, and/or video by displaying one or more image frames. For example, such electronic devices may include computers, mobile phones, portable media devices, tablets, televisions, virtual-reality headsets, vehicle dashboards, and wearable devices, among many others. To accurately display an image frame, an electronic display may control light emission (e.g., luminance) from its display pixels. However, light emission of a display pixel for displaying an image frame may be affected by light emission of the display pixel for display one or more previous image frame, a phenomenon known as hysteresis. The hysteresis exhibited by the display pixels of the electronic display may result in slow response time of the display pixels, which may affect perceived image quality of the electronic display, for example, by producing ghost images or mura effects. Moreover, for current-driven displays, such as organic light-emitting diode (OLED) displays, the response time may be even slower when displaying low luminance images or during short persistent modes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to electronic displays and, more particularly, to improving response time of electronic displays. Generally, an electronic display may display an image frame by programming display pixels with image data and instructing the display pixels to emit light. The image frame may include a first or target luminance (e.g., brightness) with which to display the image frame. Some electronic displays may achieve the first luminance by controlling the time (e.g., an emission period) the image frame is displayed. That is, the electronic displays may achieve the first luminance by displaying the image frame for a target emission period, which may be a ratio or percentage of a display period of the image frame. For example, if the first luminance of the image frame is 60% of a maximum luminance available of the electronic display, the image frame may be displayed for 60% of the display period of the image frame, resulting in displaying the image frame at the first luminance. As such, the electronic display may first program the display pixels with the image data (of the image frame). At the beginning of the display period of the image frame, the electronic display may not emit light from the display pixels (e.g., for 40% of the display period—a non-emission period), and then emit light (e.g., for the remaining 60% of the display period—the emission period). In this manner, the electronic display may display the image frame at the first luminance.

To reduce likelihood of hysteresis affect perceived image quality of a subsequent image frame, the electronic display may reset the display pixels (e.g., a target voltage may be applied to the display pixels) to relax the display pixels by overwriting previous image frame data causing the hysteresis. In particular, the display pixels may emit light after programming the image data for the emission period, and then stop emitting light for the non-emission period (i.e., after the emission period). During the non-emission period, the display pixels may be reset. As image frames are typically displayed row (of display pixels) by row, each row may be sequentially programmed with image data and instructed to emit and then stop emitting light.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "including" and "having" are intended to be inclusive and mean that there may be additional elements other than the listed elements. Additionally, it should be understood that references to "one embodiment," "an embodiment," "embodiments," and "some embodiments" of the present disclosure are not intended to be interpreted as excluding the existence of additional embodiments that also incorporate the recited features.

Figure 1:
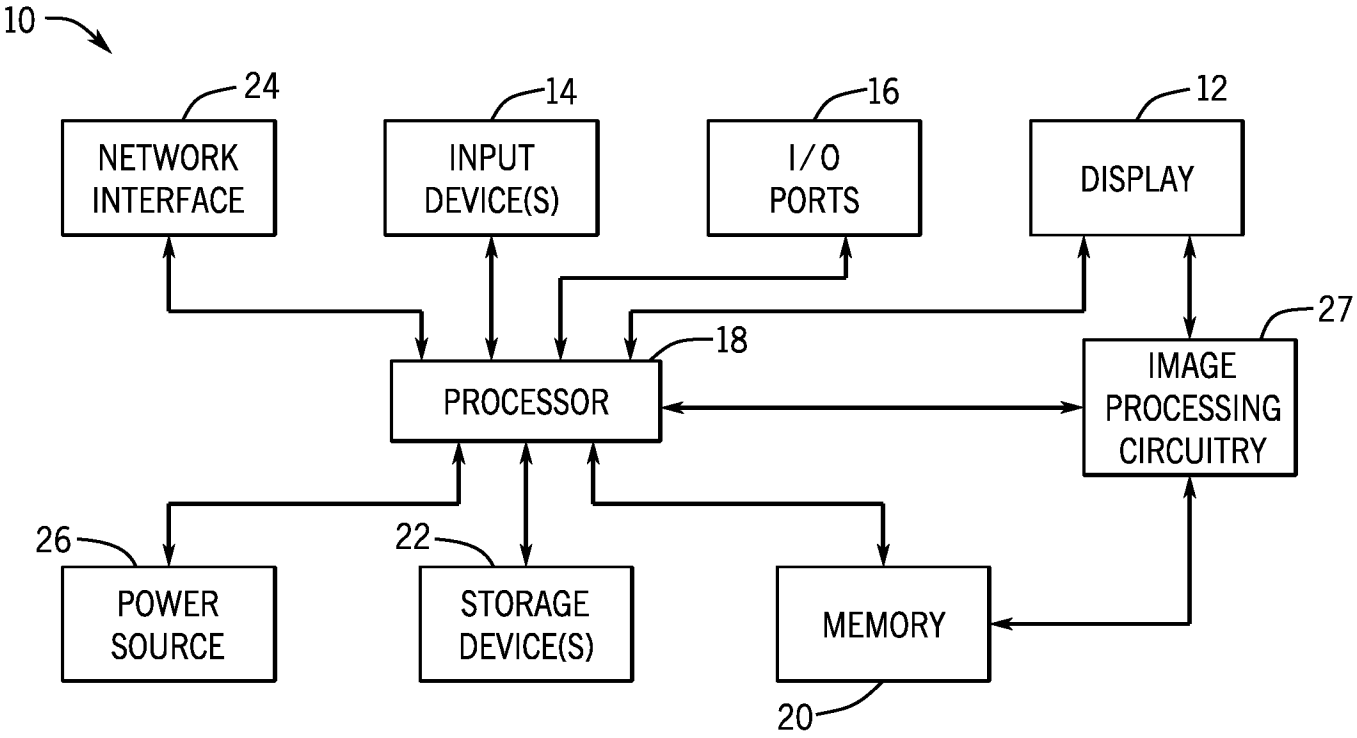
FIG. 1 is a block diagram of an electronic device used to display image frames, in accordance with an embodiment of the present disclosure.

To reduce hysteresis, display pixels of an electronic display may be reset to relax the display pixels by overwriting previous image frame data causing the hysteresis. To help illustrate, an electronic device 10 including an electronic display 12 is shown in FIG. 1. As will be described in more detail below, the electronic device 10 may be any suitable electronic device, such as a computer, a mobile phone, a portable media device, a tablet, a television, a virtual-reality headset, a vehicle dashboard, and the like. Thus, it should be noted that FIG. 1 is merely one example of a particular implementation and is intended to illustrate the types of components that may be present in the electronic device 10.

In the depicted embodiment, the electronic device 10 includes the electronic display 12, one or more input devices 14, one or more input/output (I/O) ports 16, a processor core complex 18 having one or more processor(s) or processor cores, local memory 20, a main memory storage device 22, a network interface 24, a power source 26, and image processing circuitry 27. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components. For example, the local memory 20 and the main memory storage device 22 may be included in a single component. Additionally, the image processing circuitry 27 (e.g., a graphics processing unit) may be included in the processor core complex 18.

As depicted, the processor core complex 18 is operably coupled with local memory 20 and the main memory storage device 22. Thus, the processor core complex 18 may execute instruction stored in local memory 20 and/or the main memory storage device 22 to perform operations, such as generating and/or transmitting image data. As such, the processor core complex 18 may include one or more general purpose microprocessors, one or more application specific processors (ASICs), one or more field programmable logic arrays (FPGAs), or any combination thereof.

In addition to executable instructions, the local memory 20 and/or the main memory storage device 22 may store data to be processed by the processor core complex 18. Thus, in some embodiments, the local memory 20 and/or the main storage device 22 may include one or more tangible, non-transitory, computer-readable mediums. For example, the local memory 20 may include random access memory (RAM) and the main memory storage device 22 may include read only memory (ROM), rewritable non-volatile memory such as flash memory, hard drives, optical discs, and the like.

As depicted, the processor core complex 18 is also operably coupled with the network interface 24. In some embodiments, the network interface 24 may facilitate communicating data with another electronic device and/or a network. For example, the network interface 24 (e.g., a radio frequency system) may enable the electronic device 10 to communicatively couple to a personal area network (PAN), such as a Bluetooth network, a local area network (LAN), such as an 802.11x Wi-Fi network, and/or a wide area network (WAN), such as a 4G or LTE cellular network.

Additionally, as depicted, the processor core complex 18 is operably coupled to the power source 26. In some embodiments, the power source 26 may provide electrical power to one or more component in the electronic device 10, such as the processor core complex 18 and/or the electronic display 12. Thus, the power source 26 may include any suitable source of energy, such as a rechargeable lithium polymer (Li-poly) battery and/or an alternating current (AC) power converter.

Furthermore, as depicted, the processor core complex 18 is operably coupled with the I/O ports 16. In some embodiments, the I/O ports 16 may enable the electronic device 10 to interface with other electronic devices. For example, a portable storage device may be connected to an I/O port 16, thereby enabling the processor core complex 18 to communicate data with the portable storage device.

As depicted, the electronic device 10 is also operably coupled with input devices 14. In some embodiments, the input device 14 may facilitate user interaction with the electronic device 10, for example, by receiving user inputs. Thus, the input devices 14 may include a button, a keyboard, a mouse, a trackpad, and/or the like. Additionally, in some embodiments, the input devices 14 may include touch-sensing components in the electronic display 12. In such embodiments, the touch sensing components may receive user inputs by detecting occurrence and/or position of an object touching the surface of the electronic display 12.

In addition to enabling user inputs, the electronic display 12 may include a display panel with one or more display pixels. As described above, the electronic display 12 may control light emission from the display pixels to present visual representations of information, such as a graphical user interface (GUI) of an operating system, an application interface, a still image, or video content, by display image frames based at least in part on corresponding image data. In some embodiments, the electronic display 12 may be a display using light-emitting diodes (LED display), a self-emissive display, such as an organic light-emitting diode (OLED) display, or the like. Additionally, in some embodiments, the electronic display 12 may refresh display of an image and/or an image frame, for example, at 60 Hz (corresponding to refreshing 60 frames per second), 120 Hz (corresponding to refreshing 120 frames per second), and/or 240 Hz (corresponding to refreshing 240 frames per second).

As depicted, the electronic display 12 is operably coupled to the processor core complex 18 and the image processing circuitry 27. In this manner, the electronic display 12 may display image frames based at least in part on image data generated by the processor core complex 18 and/or the image processing circuitry 27. Additionally or alternatively, the electronic display 12 may display image frames based at least in part on image data received via the network interface 24 and/or the I/O ports 16.

Figure 2:
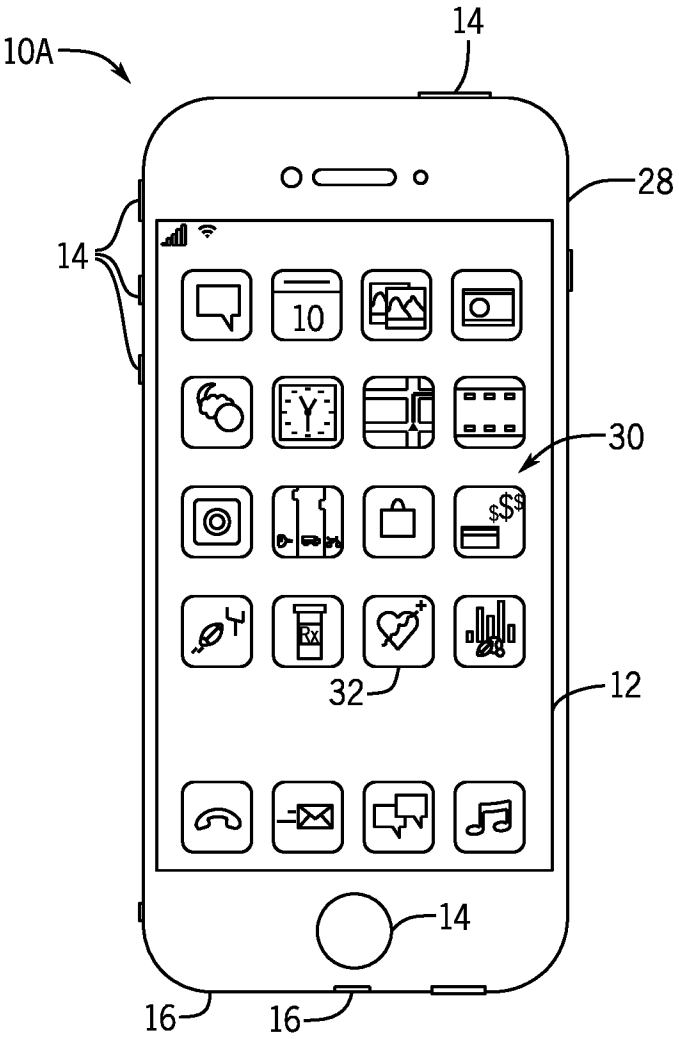
FIG. 2 is one example of the electronic device of FIG. 1, in accordance with an embodiment of the present disclosure.

As described above, the electronic device 10 may be any suitable electronic device. To help illustrate, one example of a suitable electronic device 10, specifically a handheld device 10A, is shown in FIG. 2. In some embodiments, the handheld device 10A may be a portable phone, a media player, a personal data organizer, a handheld game platform, and/or the like. For example, the handheld device 10A may be a smart phone, such as any iPhone® model available from Apple Inc.

As depicted, the handheld device 10A includes an enclosure 28 (e.g., housing). In some embodiments, the enclosure 28 may protect interior components from physical damage and/or shield them from electromagnetic interference. Additionally, as depicted, the enclosure 28 surrounds the electronic display 12. In the depicted embodiment, the electronic display 12 is displaying a graphical user interface (GUI) 30 having an array of icons 32. By way of example, when an icon 32 is selected either by an input device 14 or a touch-sensing component of the electronic display 12, an application program may launch.

Furthermore, as depicted, input devices 14 extend through the enclosure 28. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. As depicted, the I/O ports 16 also open through the enclosure 28. In some embodiments, the I/O ports 16 may include, for example, an audio jack to connect to external devices.

Figure 3:
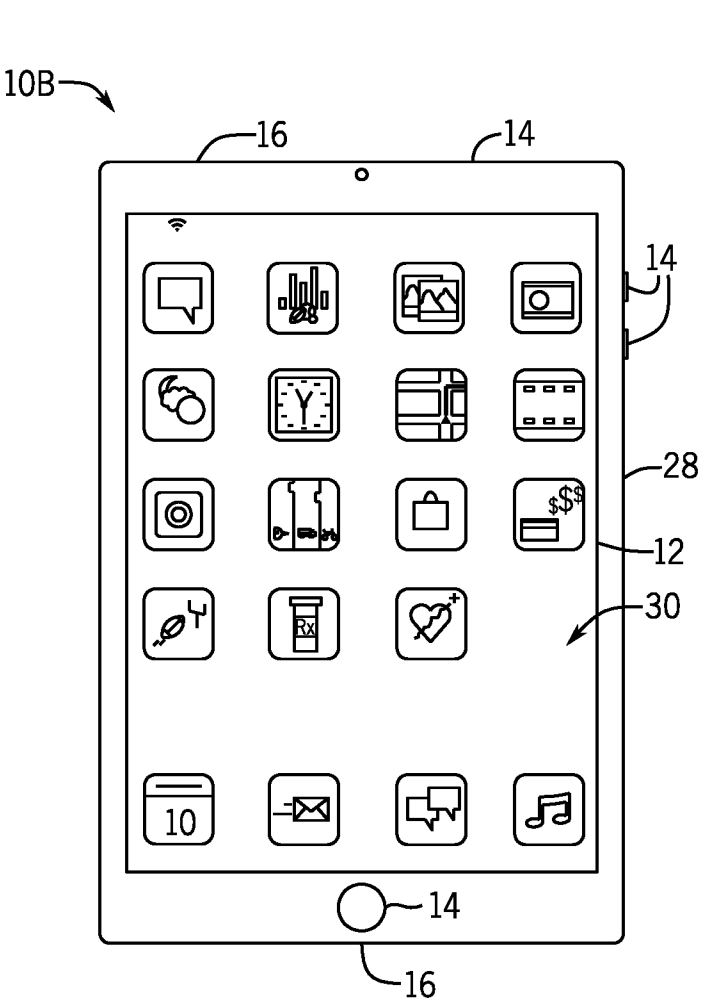
FIG. 3 is another example of the electronic device of FIG. 1, in accordance with an embodiment of the present disclosure.
Figure 4:
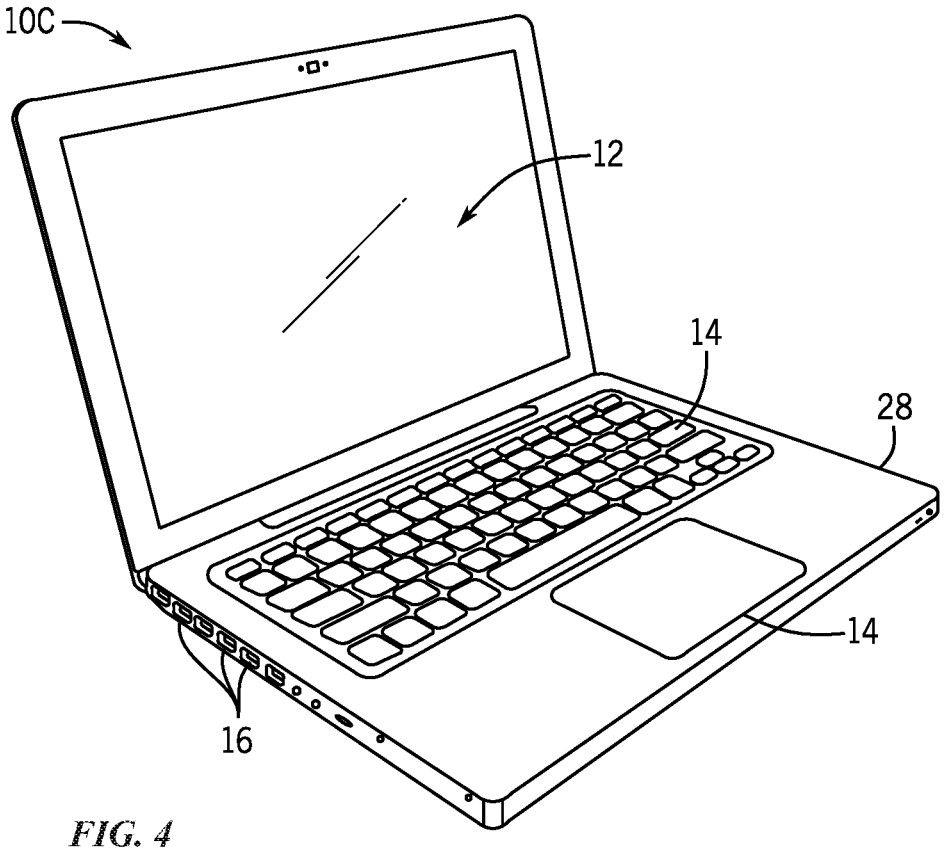
FIG. 4 is another example of the electronic device of FIG. 1, in accordance with an embodiment of the present disclosure.
Figure 5:
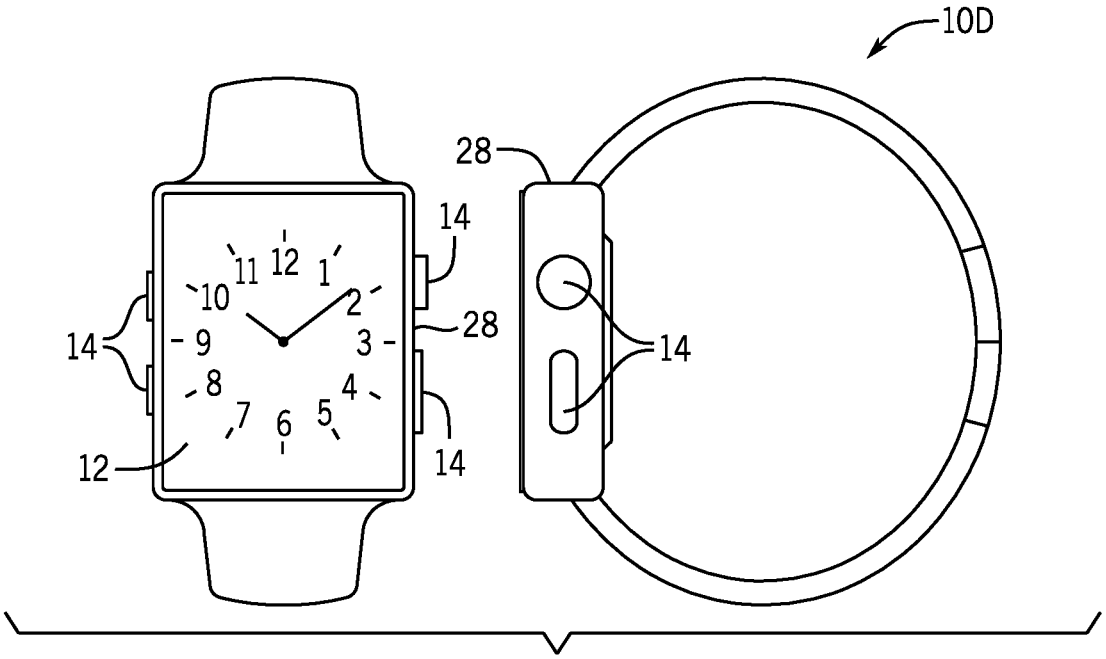
FIG. 5 is another example of the electronic device of FIG. 1, in accordance with an embodiment of the present disclosure.

To further illustrate an example of a suitable electronic device 10, specifically a tablet device 10B, is shown in FIG. 3. For illustrative purposes, the tablet device 10B may be any iPad® model available from Apple Inc. A further example of a suitable electronic device 10, specifically a computer 10C, is shown in FIG. 4. For illustrative purposes, the computer 10C may be any Macbook® or iMac® model available from Apple Inc. Another example of a suitable electronic device 10, specifically a watch 10D, is shown in FIG. 5. For illustrative purposes, the watch 10D may be any Apple Watch® model available from Apple Inc. As depicted, the tablet device 10B, the computer 10C, and the watch 10D each also includes an electronic display 12, input devices 14, and an enclosure 28.

Figure 6:
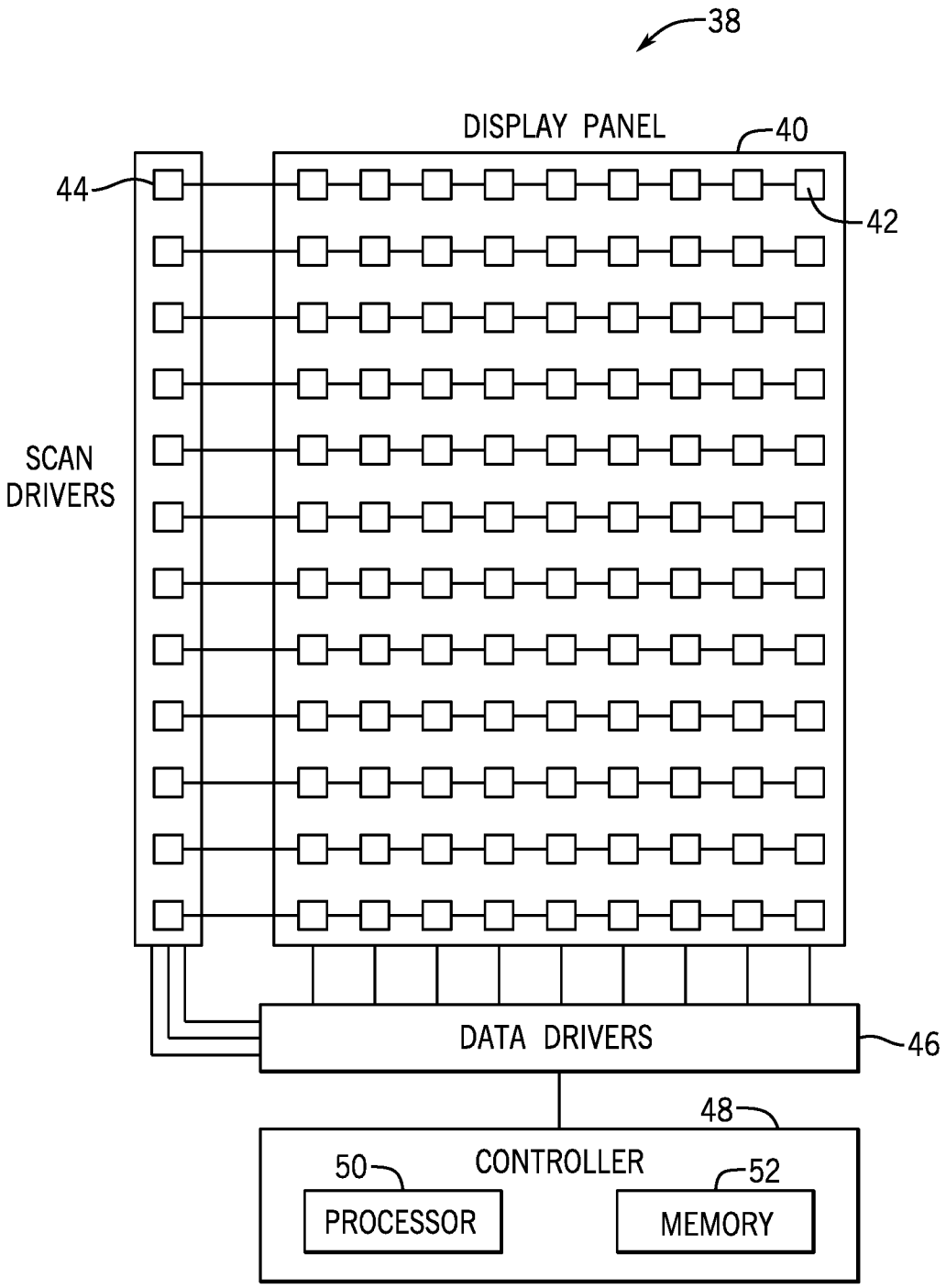
FIG. 6 is a high-level schematic diagram of display driver circuitry of the electronic display of FIG. 1, in accordance with an embodiment of the present disclosure.

With the foregoing in mind, a schematic diagram of display driver circuitry 38 of the electronic display 12 is shown in FIG. 6. The display driver circuitry 38 may include circuitry, such as one or more integrated circuits, state machines made of discrete logic and other components, and the like, that provide an interface function between, for example, the processor 18 and/or the image processing circuitry 27 and the display 12. As depicted, the display driver circuitry 38 includes a display panel 40 with multiple display pixels 42 arranged in rows and columns. A set of scan drivers 44 and a set of data drivers 46 are communicatively coupled to the display pixels 42. As illustrated, one scan driver 44 is communicatively coupled to each row of display pixels 42, and one data driver 46 is communicatively coupled to each column of display pixels 42. A scan driver 44 may supply one or more scan signals or control signals (e.g., voltage signals) to a display pixel row (e.g., row of display pixels) to control operation (e.g., programming, writing, and/or emission period) of the row. The scan drivers 44 may be daisy chained together, such that a single control signal may be sent to the set of scan drivers 44 to display an image frame. Timing of the control signal may be controlled by propagation of the control signal through the set of scan drivers 44. A data driver 46 may supply one or more data signals (e.g., voltage signals) to a display pixel column to program (e.g., write) one or more display pixel in the column. In some embodiments, electrical energy may be stored in a storage component (e.g., capacitor) of a display pixel to control magnitude of current (e.g., via one or more programmable current sources) to facilitate controlling light emission from the display pixel. It should be noted that any suitable arrangement of communicatively coupling scan drivers 44 and data drivers 46 to the display pixels 42 is contemplated (e.g., communicatively coupling one or more scan drivers 44 and/or one or more data drivers 46 to one or more display pixels 42).

As depicted, a controller 48 is communicatively coupled to the data drivers 46. The controller 48 may instruct the data drivers 46 to provide one or more data signals to the display pixels 42. The controller 48 may also instruct the scan drivers 44 to provide one or more control signals to the display pixels 42 (via the data drivers 46). While the controller 48 is shown as part of the display panel 40, it should be understood that the controller 48 may be external to the display panel 40. Moreover, the controller 48 may be communicatively coupled to the scan drivers 44 and the data drivers 46 in any suitable arrangement (e.g., directly coupling to the scan drivers 44, directly coupling to the scan drivers 44 and the data drivers 46, and the like). The controller 48 may include one or more processors 50 and one or more memory devices 52. In some embodiments, the processor(s) 50 may execute instructions stored in the memory device(s) 52. Thus, in some embodiments, the processor(s) 50 may be included in the processor core complex 18, the image processing circuitry 27, a timing controller (TCON) in the electronic display 12, and/or a separate processing module. Additionally, in some embodiments, the memory device(s) 52 may be included in the local memory 20, the main memory storage device 22, and/or one or more separate tangible, non-transitory, computer readable media.

The controller 48 may control the display panel 40 to display an image frame at a first or target luminance or brightness. For example, the controller 48 may receive image data from an image data source that indicates the target luminance of one or more display pixels 42 for displaying an image frame. The controller 48 may display the image frame by controlling (e.g., by using a switching element) magnitude and/or duration (e.g., an emission period) current is supplied to light-emission components (e.g., an OLED) to facilitate achieving the target luminance.

That is, the controller 48 may display the image frame for a target emission period, which may be a ratio or percentage of a display period of the image frame. For example, if the target luminance of the image frame is 60% of a maximum luminance available of the electronic display, the controller 48 may switch on the display pixels to emit light for a ratio or percentage (e.g., 60%) of a display period of the image frame that results in displaying the image frame at the target luminance. The controller 48 may switch off light emitting devices of the display pixels to stop emitting light for the remainder (e.g., 40%) of the display period. In this manner, the controller 48 may instruct the display panel 40 to display the image frame at the target luminance. In some embodiments, the controller 48 may also control magnitude of the current supplied to enable light emission to control luminance of the image frame.

Figure 7:
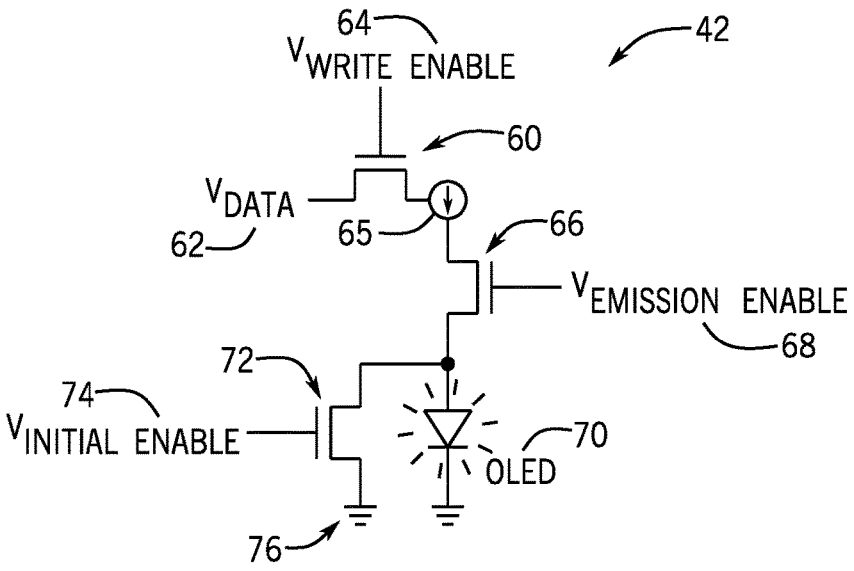
FIG. 7 is a schematic diagram of a display pixel of the electronic display of FIG. 6, in accordance with an embodiment of the present disclosure.

A more detailed view of a display pixel 42 is shown in FIG. 7. The display pixel 42 includes a switching and storage device 60, such as a first transistor. In alternative embodiments, the first transistor 60 may be any suitable component or components that provide switching and storage functionality (e.g., one or more switches). The first transistor 60 may provide a data voltage 62, $V_{data}$, when in a conducting state. The data voltage 62 may be provided by a data signal line coupled to a data driver 46. The first transistor 60 may operate in a conducting or non-conducting state based on a write enable voltage 64, $V_{write\ enable}$, which may be provided by a scan signal line coupled to a scan driver 44. In particular, the controller 48 may instruct the scan driver 44 to send the write enable voltage 64 to set the transistor 60 in the conducting state and instruct the data driver 46 to send the data voltage 62 that programs a programmable current source 65 of the display pixel 42 to produce a target current, for example, by selectively connecting to a power supply in a feedback loop. In this manner, the controller 48 may program an output (e.g., color, luminance, and the like) of the display pixel 42 via the first transistor 60. The controller 48 may also instruct the data driver 46 to send a reset signal or voltage via the data voltage 62 to reset the programmable current source 65. The reset voltage may be any suitable voltage that resets or relaxes the first transistor 60 and reduces hysteresis by overwriting previous image data stored in the first transistor 60. In some embodiments, the reset voltage may be associated with default image data supplied by the current source 65. The default image may be independent of the image data used to display an image frame to sufficiently reset or relax the first transistor 60.

The display pixel 42 includes a switching device 66, such as a second transistor. In alternative embodiments, the second transistor 66 may be any suitable component or components that provide switching functionality (e.g., a switch). The second transistor 66 may selectively provide current from the programmable current source 65 to light emitting device 70, such as an organic light emitting diode (OLED). The second transistor 66 may operate in a conducting or non-conducting state based on an emission enable voltage 68, $V_{emission\ enable}$, which may be provided by a scan signal line coupled to a scan driver 44. When in the conducting state, the second transistor 66 may provide the current from the programmable current source 65 to light emitting device 70. In particular, the controller 48 may instruct the scan driver 44 to send the emission enable voltage 68 to set the second transistor 66 in the conducting state, thereby electrically coupling the programmable current source 65 to the light emitting device 70. As described above, the output (e.g., color, luminance, and the like) of the OLED 70 may be controlled based on the magnitude of supplied current and/or duration current is supplied to the OLED 70. In this manner, the controller 48 may control an output (e.g., color, luminance, and the like) of the OLED 70.

The display pixel 42 also includes an additional switching device 72, such as a third transistor. In alternative embodiments, the third transistor 72 may be any suitable component or components that provide switching functionality (e.g., a switch). The third transistor 72 may provide an initial voltage 76 (e.g., ground) to the display pixel 42 to initialize the display pixel 42 when in a conducting state. The third transistor 72 may operate in a conducting or non-conducting state based on an initial enable voltage 74, $V_{initial\ enable}$, which may be provided by a scan signal line coupled to a scan driver 44. While the initial voltage 76 is a ground voltage (e.g., zero voltage) in FIG. 7, it should be noted that the initial voltage 76 may be any suitable voltage used to initialize the display pixel 42 to prepare the display pixel 42 to display an image frame.

When transitioning between display of successive frames, light emission in display pixels 42 associated with displaying a first frame may lag, negatively impacting light emission in display pixels 42 associated with displaying a subsequent (e.g., second) frame, a phenomenon known as hysteresis. Hysteresis may be caused by a magnitude of a constant current supplied by the current source 65 coupled to the OLED 70 used to display a previous frame affecting a magnitude of a constant current used to display a subsequent frame, thus affecting the luminance of the display pixels 42 when displaying the subsequent frame. Hysteresis may cause slow response time of the display pixels 42 and reduce perceived image quality (e.g., by creating ghost images or mura effects).

Moreover, perceivability of the hysteresis effects may increase at lower target luminance (e.g., shorter emission duration) because a ramp rate (e.g., an emission on delay) of a display pixel 42 may be affected by the magnitude of constant current output from the current source 65. That is, the higher the current output from the current source 65, the faster the voltage and current across the OLED 70 may ramp, thus reaching a steady state (e.g., target) luminance faster, and vice versa. Because the ramp rate is unaffected by an emission duration, and image data with a lower target luminance is displayed with a shorter emission duration, ramping before reaching the steady state luminance takes a larger portion of the display period of the image frame.

Figure 8:
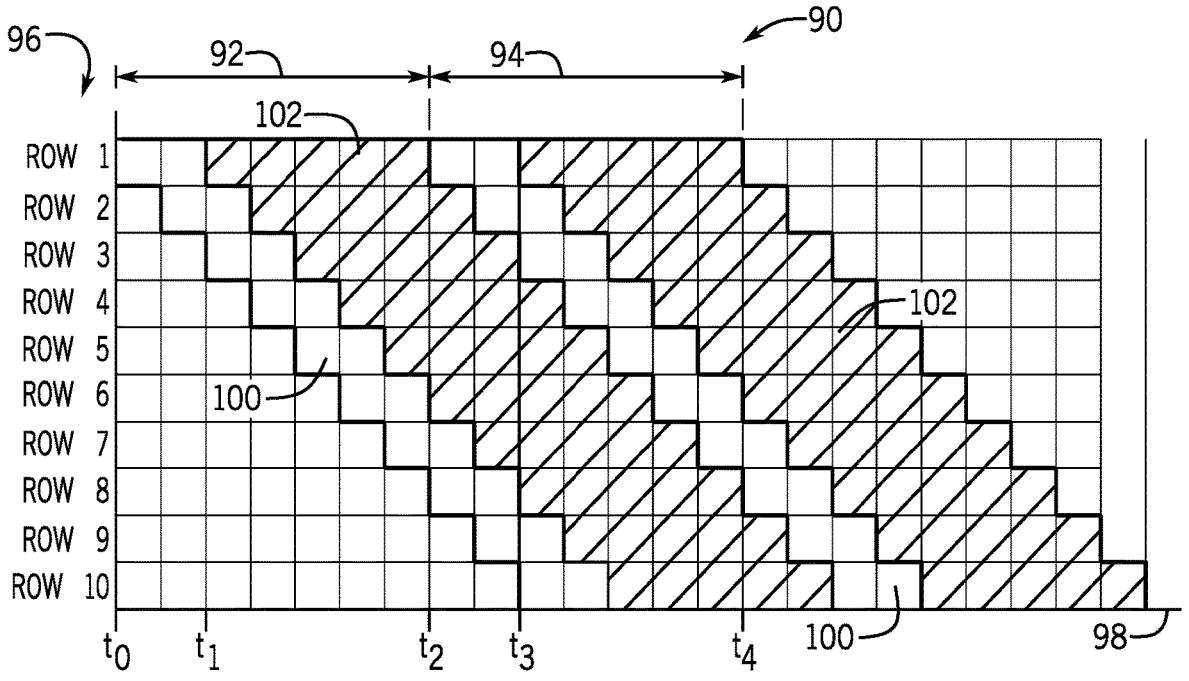
FIG. 8 is an example timing graph of display pixels displaying two image frames.

To help illustrate, an example timing graph 90 describing operation of display pixels for displaying a first image frame 92 followed by a second image frame 94 is shown in FIG. 8. The vertical axis 96 of the graph 90 represents display pixels of each row (e.g., rows 1-10) of a display panel, and the horizontal axis 98 represents time. As illustrated, each row is first programmed with image data during a programming period 100. Before the programming period 100, the display pixel row may be instructed to stop emitting light. After the programming period 100, each row emits light to display the pixels of the row during an emission period 102. For example, a controller may program display pixel Row 1 from $t_0$ to $t_1$, instruct Row 1 to emit light from $t_1$ to $t_2$, program Row 1 again from $t_2$ to $t_3$, and instruct Row 1 to emit light again from $t_3$ to $t_4$. As illustrated, the controller may sequentially program each subsequent display pixel row (e.g., Row 2) with image data, instruct each subsequent row to emit light, and instruct each subsequent row to stop emitting light.

Figure 9:
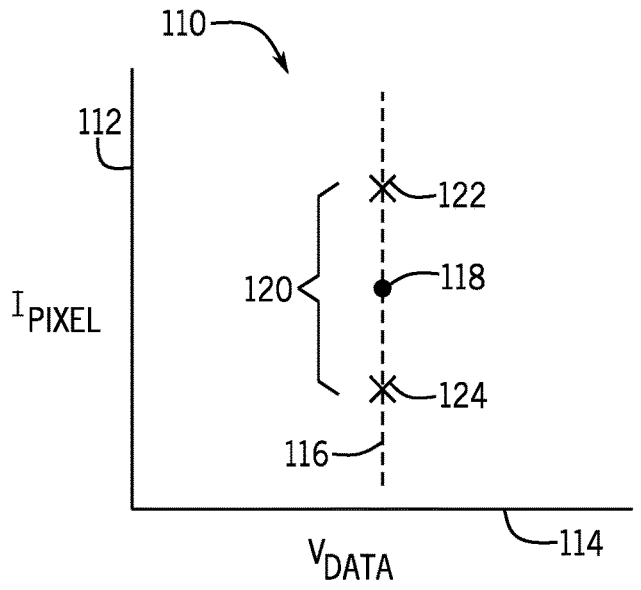
FIG. 9 is an example graph showing a current-voltage characteristic of a display pixel of FIG. 8.

However, when transitioning between frame 92 and frame 94, light emission in display pixels associated with displaying frame 92 may lag, negatively impacting light emission in display pixels associated with displaying frame 94. FIG. 9 is an example graph showing a current-voltage characteristic 110 of a display pixel of FIG. 8. The vertical axis 112 of the graph represents current in the display pixel 42 and the horizontal axis 114 represents voltage of a data signal (e.g., associated with image data) provided to the display pixel. The data voltage 116 may illustrate a certain voltage associated with image data for the display pixel to display. An ideal or target current-voltage 118 represents a target current (and thus luminance) the display pixel should display the image data. However, due to hysteresis, an actual current-voltage may vary from the target current-voltage 118. In particular, a range of current-voltage 120 may illustrate actual current-voltage due to hysteresis (from displaying a previous image frame). A first endpoint 122 of the range of current-voltage 120 may represent a case where the previous image frame is black (e.g., 0% luminance). A second endpoint 124 of the range 120 may represent a case where the previous image frame is white (e.g., 100% luminance). As such, hysteresis from displaying the previous image frame may cause luminance variance from an ideal or target luminance when displaying a subsequent image frame.

To reduce likelihood of hysteresis affecting perceived image quality, the controller 48 may reset the display pixels 42 by applying a target (e.g., reset) voltage. Applying the target voltage to the display pixels 42 may relax the display pixels 42 by overwriting previous image frame data, which otherwise may result in hysteresis. The controller 48 may reset the display pixels 42 during a non-emission period of the display pixels 42 (e.g., after the controller 48 instructs the display pixels 42 to stop emitting light).

Figure 10:
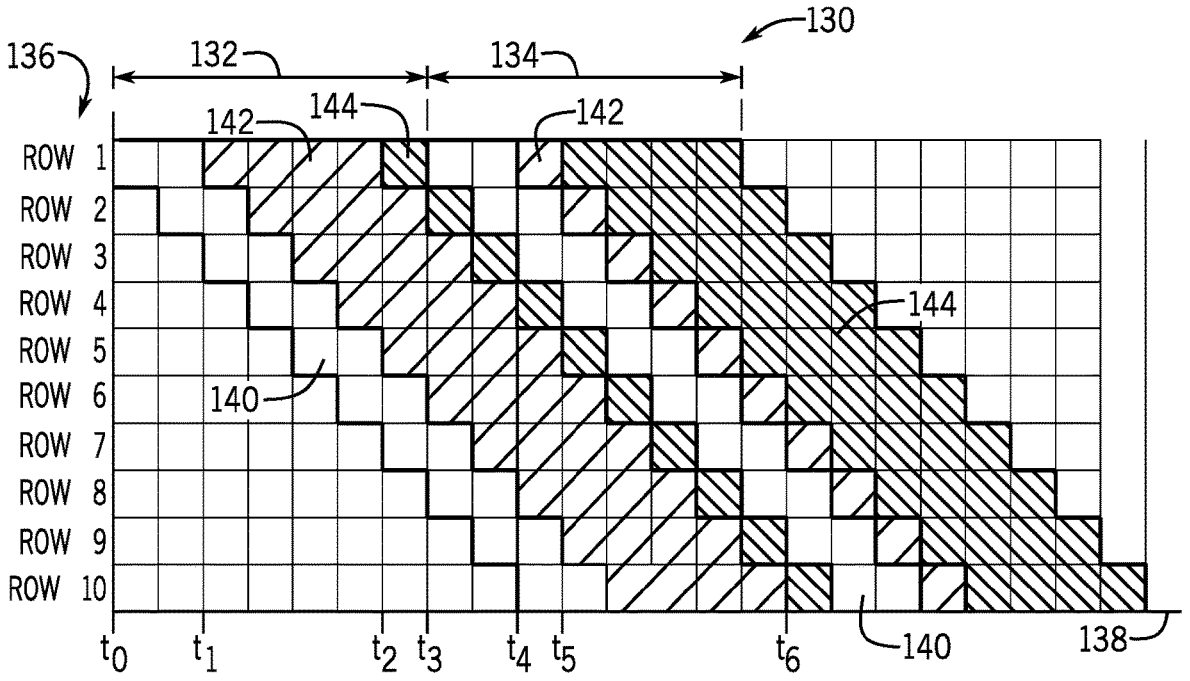
FIG. 10 is an example timing graph of the display pixels of FIG. 7 displaying two image frames, in accordance with an embodiment of the present disclosure.

To help illustrate, an example timing graph 130 describing operation of the display pixels 42 for displaying a first image frame 132 followed by a second image frame 134 is shown in FIG. 10. The vertical axis 136 of the graph 130 represents display pixels 42 of each row (e.g., rows 1-10) of the display panel 40, and the horizontal axis 138 represents time. As illustrated, each row is first programmed with image data during a programming period 140. Before the programming period 140, the display pixel row may be instructed to stop emitting light. After the programming period 140, each row emits light to display the pixels 42 of the row during an emission period 142. After the emission period 142, the controller 48 instructs each row to stop emitting light and reset during a reset period 144. For example, the controller 48 may program display pixel Row 1 from $t_0$ to $t_1$, instruct Row 1 to emit light from $t_1$ to $t_2$, instruct Row 1 to stop emitting light and reset Row 1 from $t_2$ to $t_3$, program Row 1 again from $t_3$ to $t_4$, instruct Row 1 to emit light again from $t_4$ to $t_5$, and instruct Row 1 to stop emitting light and reset Row 1 from $t_5$ to $t_6$.

In other words, the controller 48 may sequentially program each display pixel row (e.g., Row 2) with image data, instruct each row to emit light, instruct each row to stop emitting light, and instruct each row to reset. FIG. 10 also illustrates a difference between displaying image frames of different luminance. For example, Row 1 emits light when displaying frame 132 for a time period (i.e., from $t_1$ to $t_2$) that is greater than that of frame 134 (i.e., from $t_4$ to $t_5$). Resetting a row of display pixels 42 immediately or shortly after the row stops emitting light may increase relaxation duration, thereby reducing likelihood that hysteresis due to display of a previous frame (e.g., frame 132) affects perceived image quality of a subsequent frame (e.g., frame 134).

In some embodiments, the controller 48 may display an image frame using pulse-width modulation (PWM) as part of dimming control. In particular, the controller 48 may display multiple noncontiguous refresh pixel groups associated with multiple portions of the image frame, resulting in a faster refresh rate. In such cases, the controller 48 may reset the current source 65 after a last refresh pixel group to reduce hysteresis.

Figure 11:
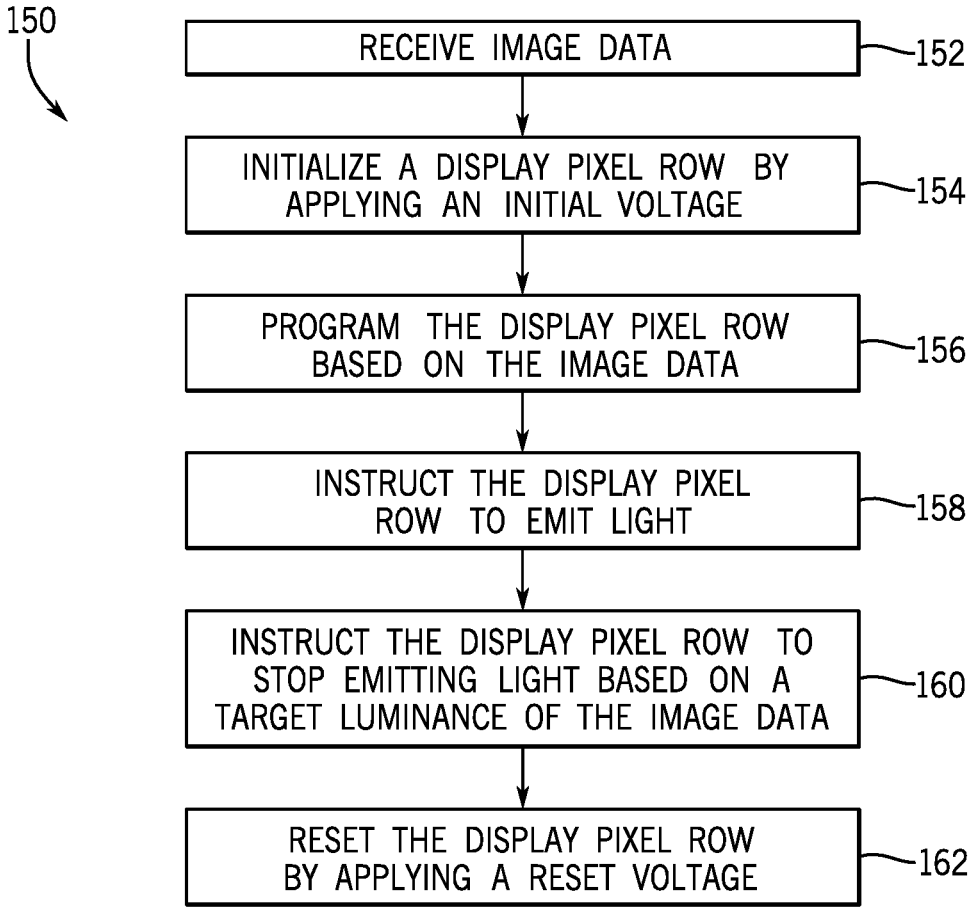
FIG. 11 is a flow diagram of a process for resetting the display pixel of FIG. 7 to improve display response time, in accordance with an embodiment of the present disclosure.

One embodiment of a process 150 for resetting the display pixel 42 of FIG. 7 to improve display response time is described in FIG. 11. Generally, the process 150 includes receiving image data (process block 152), initializing a display pixel row by applying an initial voltage (process block 154), programming the display pixel row based on the image data (process block 156), instructing the display pixel row to emit light (process block 158), instructing the display pixel row to stop emitting light based on a target luminance of the image data (process block 160), and resetting the display pixel row by applying a reset voltage (process block 162). The process 150 may be implemented by the display driver circuitry 38. In some embodiments, the process 150 may be implemented by executing instructions stored in a tangible, non-transitory, computer-readable medium, such as the memory device(s) 52, using a processor, such as the processor(s) 50.

Accordingly, in some embodiments, the controller 48 may receive image data (process block 152). For example, the controller 48 may receive content of an image frame from an image data source. In some embodiments, the content may include information related to luminance, color, variety of patterns, amount of contrast, change of image data corresponding to an image frame compared to image data corresponding to a previous frame, and/or the like. The controller 48 may also initialize a display pixel row by applying an initial voltage to the display pixel row (process block 154). The initial voltage may be a ground voltage or any other suitable voltage that may be used to initialize the display pixel row.

The controller 48 may then program the display pixel row based on the image data (process block 156). For example, the controller 48 apply a data voltage based on the image data (e.g., a corresponding pixel row of the image data) to the programmable current source 65 such that it produces a target current expected to result in target luminance. The controller 48 may instruct the display pixel row to emit light (process block 158) once the display pixel row has been programmed. In some embodiments, the controller 48 instruct a display pixel row to emit light in response to completing the programming of the display pixel row, thereby fixing when the emission period of the display pixel row begins.

The controller 48 may then instruct the display pixel row to stop emitting light based on a target luminance of the image data (process block 160). For example, if the target luminance of the image data is 60% of a maximum luminance available of the display panel 40, the controller 48 may instruct the pixel row to stop emitting light after a ratio or percentage (e.g., 60%) of a display period of the image frame has passed, resulting in displaying the image frame at the target luminance. When the start of the emission period is fixed, the duration current is supplied to the OLED 70 may be controlled by adjusting when the display pixel row stops The controller 48 may reset the display pixel row by applying a reset voltage to the display pixel row (process block 162). The reset voltage may be any suitable voltage that resets or relaxes the display pixel row and reduces hysteresis by overwriting previous image data stored in the display pixel row. In some embodiments, the reset voltage may be associated with default image data supplied by the current source 65. The default image may be independent of the image data used to display an image frame to sufficiently reset or relax the display pixel row. For example, the controller 48 may instruct each display pixel in the display pixel row to use a data signal different from data signals associated with the image frame. In additional or alternative embodiments, the reset voltage may be associated with another data voltage based on the image data (e.g., a non-corresponding pixel row of the image data).

Thus, in some embodiments, the controller 48 may reset the display pixel row in response to the display pixel row stopping light emission. In this manner, the display pixel row may be reset immediately or shortly after the emission is stopped, thereby maximizing relaxation duration and, thus, reducing likelihood of hysteresis affecting perceived image quality of subsequent image frames.

The process 150 may be used to display image data and reset multiple display pixel rows of the display panel 40. Because the scan drivers 44 of the display panel 40 may be daisy chained together, such that a single control signal may be sent to the set of scan drivers 44 to display an image frame, the single control signal may be used to perform the process 150. Timing of the control signal may be controlled by propagation of the control signal through the set of scan drivers 44.

Figure 12:
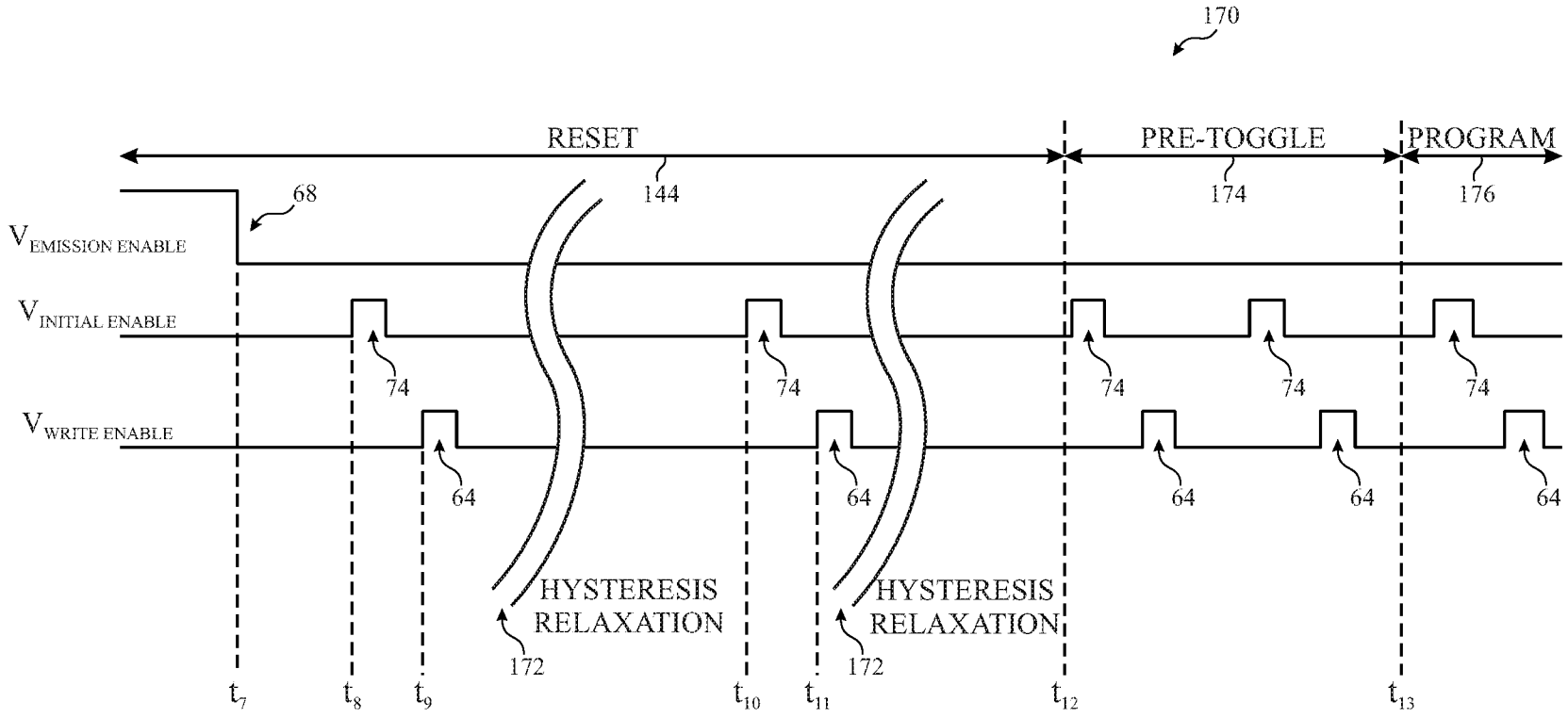
FIG. 12 is an example timing graph for using multiple reset signals to reset the display pixel of FIG. 7, in accordance with an embodiment of the present disclosure.

Referring back to block 162 of the process 150, FIG. 12 provides an example timing graph 170 for applying a reset voltage to reset the display pixel row. In one embodiment, during the reset period 144, the emission enable voltage 68, $V_{emission\ enable}$, may be removed or set to a low voltage value at time $t_7$. After the emission enable voltage 68 is reduced, the controller 48 may instruct the scan driver 44 or other suitable component to send the initial enable voltage 74, $V_{initial\ enable}$, to the third transistor 72 at time $t_8$. Soon thereafter, at time $t_9$, the controller 48 may instruct the scan driver 44 to send the write enable voltage 64, $V_{write\ enable}$, to the transistor 60. The data voltage 62, which may include the reset voltage or reset signal, may then be provided to the light emitting device 70. As mentioned above, after the reset voltage is provided to the light emitting device 70, the light emitting device 70 may reset or relax to compensate for the hysteresis effect described above. In some embodiments, the controller 48 may provide just one reset voltage via the data voltage 62 prior to programming the respective light emitting device 70. However, to further improve the reduction of the hysteresis effect, the controller 48 may again send the initial enable voltage 74, $V_{initial\ enable}$, to the third transistor 72 (e.g., at time $t_{10}$) and send the write enable voltage 64, $V_{write\ enable}$, to the transistor 60 (e.g., at time $t_{11}$) to reset the light emitting device 70 again to further reduce the hysteresis effect between frames of image data. In particular, by resetting the light emitting device 70, the controller 48 may reduce cross-talk between frames of image data that may inhibit the ability of the light emitting device 70 from achieving a target luminance when displaying a subsequent image frame due to a luminance variance associated with a previous image frame.

Although FIG. 12 illustrates using two reset signals (e.g., one reset signal includes both $V_{initial\ enable}$ and $V_{write\ enable}$ pulses) during the reset period 144, it should be noted that any suitable number of reset signals may be sent to the light emitting device 70 to sufficiently reduce the likelihood of hysteresis affecting the image quality depicted on the display 12. For example, after each reset signal is provided to the light emitting device 70 as shown in the timing graph 170, a hysteresis relaxation period 172 may occur.

After resetting the light emitting device 70 using the one or more reset signals, the controller 48 may begin to pre-toggle the light emitting device 70 during a pre-toggle period 174 (e.g., between time $t_{12}$ and time $t_{13}$). Pre-toggling the light emitting device 70 may exercise or warm up the light emitting device 70 before programming the light emitting device 70 with the desired data voltage. That is, to improve the response time and accuracy of the light emitting device 70, to reduce the effects of previously stored data in the light emitting device 70 from a previous image frame, and to reduce cross-talk between data voltages provided between adjacent frames of image data, the controller 48 may pre-toggle the light emitting device 70 during the pre-toggle period 174, as illustrated in FIG. 12.

When pre-toggling the light emitting device 70, the controller 48 may provide a pre-toggle voltage value via the data voltage 62 to exercise or prepare the light emitting device 70 to receive a voltage value that corresponds to a desired image data, as received via the data voltage 62. That is, before a programming period 176 (e.g., after time $t_{13}$), the controller 48 may instruct the scan driver 44 or other suitable component to send one or more pre-toggle signals to the light emitting device 70 via the data voltage 62. In some embodiments, the number of pre-toggle signals and/or the width of the pre-toggle signals transmitted to the light emitting device 70 may be determined based on certain intrinsic properties (e.g., refresh rate, cross-talk tests) of the display 12. After pre-toggling the light emitting device 70, the controller 48 may instruct the scan driver 44 to send target data voltage signals to the light emitting device 70 via the data voltage 62 based on received image data to be depicted on the display 12.

Figure 13:
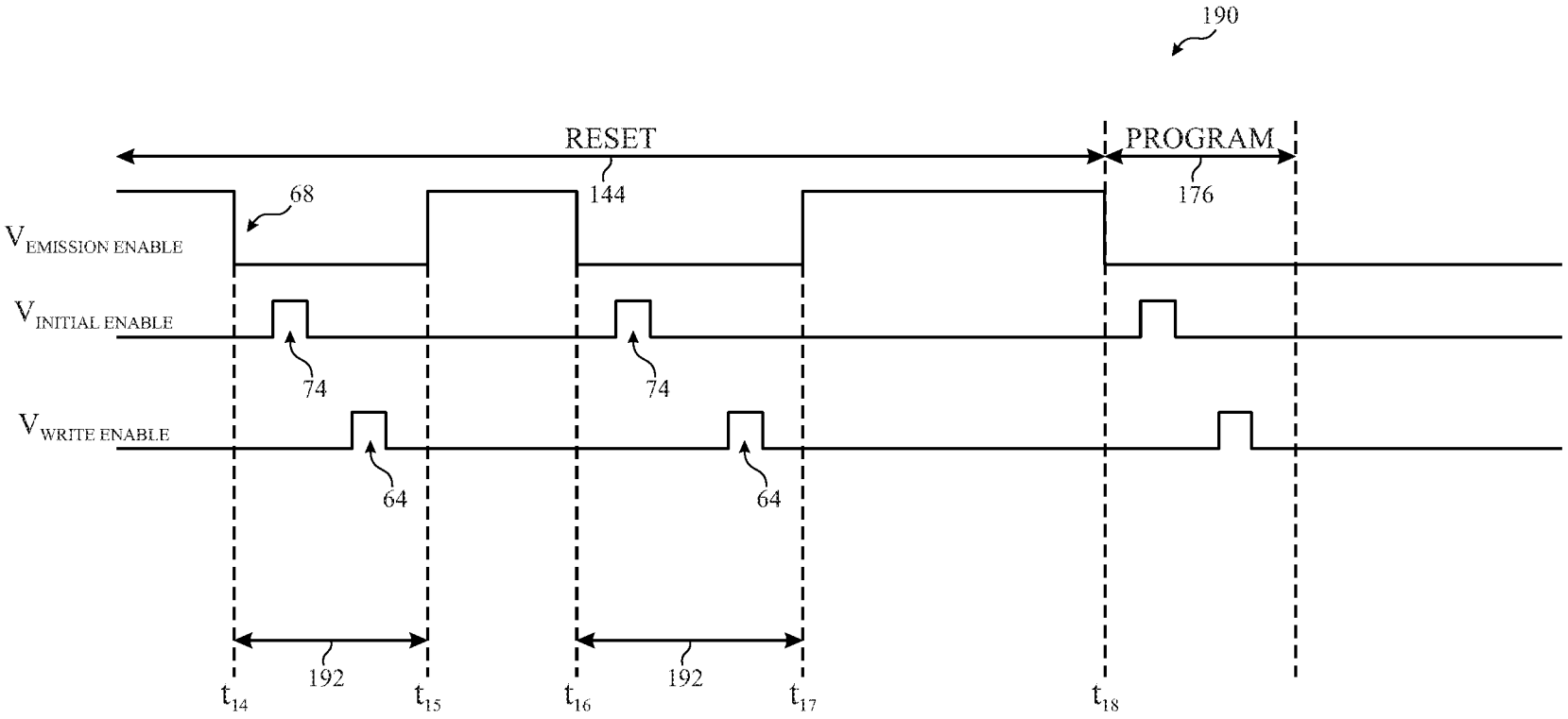
FIG. 13 is an example timing graph for using emission pre-toggling prior to writing data in the display pixel of FIG. 7, in accordance with an embodiment of the present disclosure.

Although pre-toggling the light emitting device 70 may enable the light emitting device 70 to more accurately present the image data, the use of various circuit components (e.g., clocks, transistors) to perform the pre-toggling operations may result in an inefficient use of energy or power. That is, each time the initial enable voltage 74 signal and the write enable voltage 64 signal is provided to the respective transistors, power is consumed by certain circuit components (e.g., clock circuits, transistor switching) to provide these signals to their respective destinations. As such, to reduce the number of pre-toggling signals sent to the light emitting device 70, the controller 48 may implement an emission pre-toggle sequence, as illustrated in the timing chart 190 of FIG. 13.

The emission pre-toggle sequence may include, for example, toggling the emission enable voltage 68, $V_{emission\ enable}$, between sending the reset signals. Referring to the timing chart 190 of FIG. 13, in one embodiment, the controller 48 may instruct the scan driver 44 or other suitable component to reduce the emission enable voltage 68 signal from a high voltage value to a low voltage value at time $t_{14}$. During the time period when the emission enable voltage signal is reduced, the controller 48 may send the reset signal or the initial enable voltage 74 signal and the write enable voltage 64. At time $t_{15}$, the emission enable voltage signal is returned to a high voltage value. As such, between time $t_{14}$ and time $t_{15}$, the controller 48 may reset the light emitting device 70, as described above. However, instead of keeping the emission enable voltage 68 signal low, the controller 48 may cycle the emission enable voltage 68 signal back to a high voltage and again to a low voltage value at time $t_{16}$.

When the emission enable voltage 68 signal returns to a low voltage value, the controller 48 may again reset the light emitting device 70 by transmitting the initial enable voltage 74 signal and the write enable voltage 64 to the respective transistors with the reset voltage provided via the data voltage 62. At time $t_{17}$, the controller 48 may return the emission enable voltage 68 signal to the high voltage value, thereby preventing the current source 65 from coupling to the light emitting device 70. Although two emission pre-toggle cycles 192 are described in the timing chart 190 to reset the light emitting device, it should be noted that the controller 48 may incorporate any suitable number of emission pre-toggle cycles 192 in the reset period 144.

After the reset period 144, at time $t_{18}$, the controller 48 may program the light emitting device 70 during the program period 176, as described above. By employing the emission pre-toggle cycles 192 to reset the light emitting device 70, the controller 48 may effectively reduce or eliminate pre-toggling the light emitting device 70 with a pre-toggle voltage during the pre-toggle period 174. That is, in some embodiments, the controller 48 may avoid pre-toggling the light emitting device 70 by employing the emission pre-toggle sequence described above with respect to FIG. 13. As a result, the controller 48 may provide additional power savings for the display 12 while preventing cross-talk between frames of image data.

Although the foregoing descriptions of the reset period 144 and the pre-toggle period 174 are described as employing an initial enable voltage 74 signal and a write enable voltage 64 for each reset and pre-toggle operation, in some embodiments, the controller 48 may instead just transmit the initial enable voltage 74 signal, as opposed to both the initial enable voltage 74 signal and the write enable voltage 64 signal. That is, for some types of display and/or for displays that operate according to some parameters (e.g., certain refresh rates), the transmission of the initial enable voltage 74 signal may cause the light emitting device 70 to be coupled to ground or other suitable voltage source, which may be used as the reset voltage. This connection to ground may effectively reset the light emitting device 70 to reduce the hysteresis effect and cross-talk effects between frames of image data. Indeed, by using just the initial enable voltage 74 signal, the controller 48 may reduce the ability of cross-talk between image frames because the write enable voltage 64 signal is not provided to connect the data voltage 62, which may still include data stored thereon from a previous frame of image data, to the light emitting device 70. Moreover, by avoiding the transmission of the write enable voltage 64 signal, the controller 48 may reduce the power consumed by the pixel 42 by reducing the clock cycling associated with providing the write enable voltage 64 signal to the pixel 42.

Figure 14:
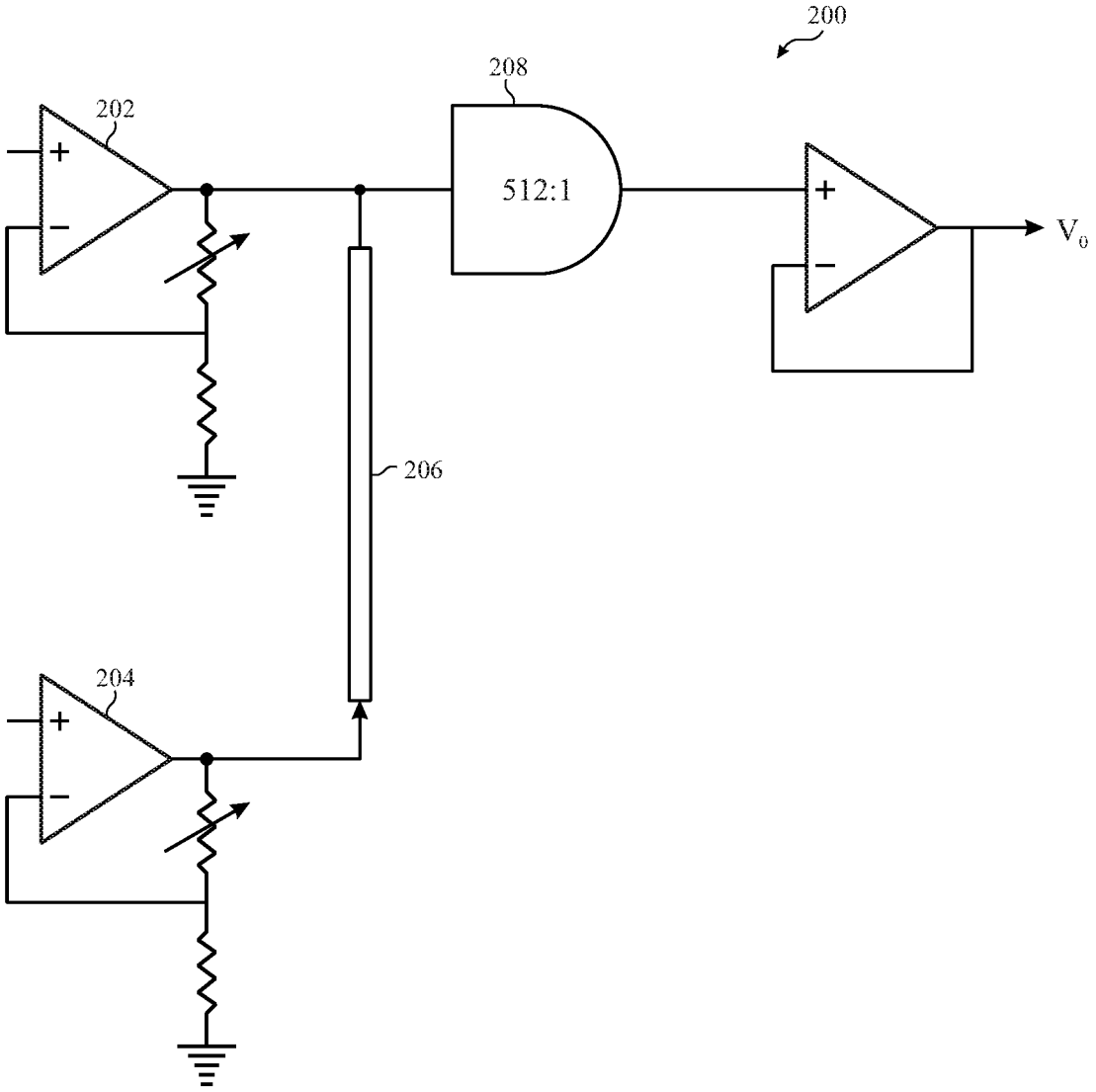
FIG. 14 is an example circuit diagram for adjusting a gray zero level based on a brightness level of a display pixel, in accordance with an embodiment of the present disclosure.

In addition to employing the various reset and pre-toggling operations described above to reduce cross-talk and hysteresis effects on the pixel 42, the controller 48 or other suitable component may adjust a gray level zero voltage value used for gray zero values (G0) in the pixel 42. That is, the gray level zero voltage value (V0) provided to the light emitting device 70 as data voltage 62 for gray level zero may contribute to the hysteresis effect due to its dependence on the display brightness value (DBV), the color of the pixel 42, the refresh rate of the display 12, the temperature of the display 12, and other properties of the display 12. With this in mind, in some embodiments, a voltage adjustment circuit 200, as illustrated in FIG. 14 may be included in the display 12 to adjust the voltage value (V0) used for depicting the gray level zero. For example, as the brightness setting for the display 12 increases, the voltage adjustment circuit 200 may increase the voltage value (V0) used for gray level zero (G0).

Referring to FIG. 14, the voltage adjustment circuit 200 may include a high voltage source 202 and a low voltage source 204 that provides a first voltage value and a second voltage value, respectively. The first voltage value may be higher than the second voltage value. The voltage adjustment circuit 200 may also include a resistor string 206 that may provide different voltage outputs based on the collection of resistors that make up the resistor string 206. In certain embodiments, the controller 48 may receive a display brightness setting value (DBV) for the display 12 and determine a gray level zero voltage value (V0) for the gray level zero based on the DBV. In some embodiments, voltage values (V0) may be mapped to DBV during a testing operation performed during manufacturing or the like. Generally, the testing operations may track the presence of the hysteresis effect on the pixel 42 for different DBVs over different gray level zero voltage values (V0).

Based on the determined gray level zero voltage value (V0), the controller 48 or other suitable component may select a voltage output from the resistor string 204 via a multiplexer 208. The output of the multiplexer 208 may then be provided to the scan drivers 44 and/or the data drivers 46 to cause the display 12 to present gray level zeros on the pixels 42 via the light emitting devices 70. By adjusting the gray level zero voltage value (V0) based on the DBV employed by the display 12, the controller 48 may prevent the pixels 42 from being affected by content depicted on previous frames of image data and the brightness employed by the display 12. As a result, the image depicted by the display 12 may have fewer artifacts and present higher quality image data.

Although the foregoing descriptions of the operation of the pixel 42 is described with p-type transistors, it should be noted that the embodiments described herein may also be implemented using n-type transistors. In this case, the polarities or voltage values of each of the various signals and voltages described above may be adjusted accordingly based on the type of switching device used to control the operation of the pixel 42.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic display, comprising:

a display panel comprising a plurality of display pixels;

a scan driver communicatively coupled to the plurality of display pixels;

a data driver communicatively coupled to the plurality of display pixels; and a controller communicatively coupled to the scan driver and the data driver, wherein the controller is configured to:

instruct the scan driver and the data driver to program a row the plurality of display pixels based on a corresponding frame of image data;

instruct the scan driver to turn on the row of the plurality of display pixels at a fixed time after programming the row of the plurality of display pixels;

instruct the scan driver to turn off the row of the plurality of display pixels based at least in part on a first luminance of the row of the plurality of display pixels; and in response to instructing the scan driver to turn off the row of the plurality of display pixels, instruct the scan driver and the data driver to reset the row of the plurality of display pixels at least two times to overwrite previous image data stored in the display pixel and reduce one or more effects of hysteresis between frames of the image data, wherein the data driver is configured to reset the row of the plurality of display pixels by programming each display pixel in the row of the plurality of display pixels with a reset voltage at least two times via a respective data line connected to each display pixel in the row of the plurality of display pixels during the frame of image data.

2. The electronic display of claim 1, wherein, to program the row of the plurality of display pixels, the controller is configured to:

instruct the data driver to provide first data signals based at least in part on the first luminance indicated by the corresponding frame of image data to each display pixel in the row of the plurality of display pixels; and instruct the scan driver to generate a first scan control signal that instructs each display pixel in the row of the plurality of display pixels to supply one of the first data signals to a respective storage component.

3. The electronic display of claim 2, wherein the respective storage component comprises a transistor, a capacitor, or both.

4. The electronic display of claim 1, wherein, to reset the row of the plurality of display pixels at least two times, the controller is configured to instruct the scan driver to remove an emission on control signal that instructs each display pixel in the row of the plurality of display pixels to connect a current source programmed based on the frame of image data to a respective light emitting device of each display pixel while programming each display pixel with the reset voltage at least two times.

5. The electronic display of claim 4, wherein the respective light emitting device comprises an organic light emitting diode.

6. The electronic display of claim 4, wherein, to turn on the row of the plurality of display pixels, the controller is configured to instruct the scan driver to output an emission on control signal that instructs each display pixel in the row of the plurality of display pixels to connect a respective current source programmed based on the frame of image to a respective light emitting device.

7. The electronic display of claim 2, wherein, to reset the row of the plurality of display pixels, the controller is configured to instruct the scan driver to generate a second scan control signal that instructs each display pixel in the row of the plurality of display pixels to use a data signal different from the first data signals to the respective storage component.

8. The electronic display of claim 2, comprising a voltage adjustment circuit configured to output a voltage associated with a zero gray level, wherein the first data signals comprise the voltage when the corresponding frame of image data comprises the zero gray level.

9. The electronic display of claim 8, wherein the voltage output by the voltage adjustment circuit is determined based on a display brightness value associated with the display panel.

10. A method for operating an electronic display, comprising:

receiving data associated with a frame of image data into display driver circuitry of the electronic display;

programming a display pixel of the electronic display based on the data associated with the frame of image data using the display driver circuitry and a data line coupled to the display pixel;

sending a first signal configured to cause the display pixel to emit light using the display driver circuitry;

sending a second signal configured to cause the display pixel to stop emitting light based on a first luminance of the data associated with the frame of image data using the display driver circuitry; and applying a reset voltage at least two times to overwrite previous image data stored in the display pixel during the frame of image data after sending the second signal to reduce one or more effects of hysteresis between frames of the image data in response to sending the second signal to cause the display pixel to stop emitting light, wherein the reset voltage is configured to reset the display pixel using the display driver circuitry and the data line.

11. The method of claim 10, wherein applying the reset voltage comprises:

initializing the display pixel by applying a first voltage using the display driver circuity; and resetting the display pixel by applying a second voltage using the display driver circuity at least two times.

12. The method of claim 10, wherein applying the reset voltage comprises initializing the display pixel by applying a first voltage using the display driver circuity.

13. The method of claim 10, comprising sending an emission on signal to the display pixel between each application of the reset voltage.

14. The method of claim 10, wherein programming the display pixel of the electronic display based on the data associated with the frame of image data comprises:

determining display brightness value associated with the electronic display;

determining a voltage value for a gray level zero of the frame of image data based on the display brightness value; and output the voltage value when the data associated with the frame of image data comprises the gray level zero.

15. An electronic device comprising:

one or more processors configured to generate image data; and an electronic display configured to display the image data over a first frame duration at least in part by:

programming a first row of display pixels with the image data;

causing the first row of display pixels to emit light for an emission duration that is based at least in part on a first luminance of the image data; and resetting the first row of display pixels to overwrite previous image data stored in the first row of the plurality of display pixels using a reset voltage at least two times before an end of the first frame duration to reduce one or more effects of hysteresis between frames of the image data in response to causing the first row of the plurality of display pixels to stop emitting light after the emission duration, wherein the reset voltage is provided to the first row of display pixels via a data driver and a plurality of data lines coupled to the first row of display pixels.

16. The electronic device of claim 15, wherein the electronic display is configured to display the image data over the first frame duration at least in part by initializing the first row of display pixels by applying an initial voltage to the first row of display pixels.

17. The electronic device of claim 16, wherein the initial voltage comprises ground.

18. The electronic device of claim 15, wherein the electronic display is configured to cycle an emission on signal between each application of the reset voltage during the resetting the first row of display pixels the at least two times.

19. The electronic device of claim 18, wherein the electronic display is configured to display the image data over the first frame duration at least in part by causing a second row of display pixels to emit light, after causing the first row of display pixels to stop emitting light after the emission duration.

20. The electronic device of claim 15, wherein the electronic display is configured to display the image data over the first frame duration at least in part by causing a second row of display pixels to stop emitting light, after programming the first row of display pixels with the image data.

* * * * *